US007968826B2

(12) United States Patent
DeAngelis et al.

(10) Patent No.: US 7,968,826 B2
(45) Date of Patent: Jun. 28, 2011

(54) CALIBRATED THERMAL SENSING SYSTEM UTILIZING RESISTANCE VARYING JUMPER CONFIGURATION

(75) Inventors: Alfred R. DeAngelis, Spartanburg, SC (US); Joshua D. Horvath, Sparta, NJ (US); Andrew D. Child, Moore, SC (US); Scott Craig Thielman, Seattle, WA (US)

(73) Assignee: Milliken & Company, Spartanburg, SC (US)

( * ) Notice: Subject to any disclaimer, the term of this patent is extended or adjusted under 35 U.S.C. 154(b) by 1075 days.

(21) Appl. No.: 11/417,728

(22) Filed: May 4, 2006

(65) Prior Publication Data

US 2007/0257024 A1 Nov. 8, 2007

(51) Int. Cl.
*H05B 1/02* (2006.01)
*H05B 3/34* (2006.01)
*H01C 10/00* (2006.01)

(52) U.S. Cl. ..... 219/494; 219/212; 219/505; 219/529; 219/553; 338/195; 338/295

(58) Field of Classification Search ..... 219/201, 219/211, 212, 217, 482, 484, 488, 489, 490, 219/494, 501, 505, 527, 528, 529, 553; 338/195, 338/295, 320
See application file for complete search history.

(56) References Cited

U.S. PATENT DOCUMENTS

| | | | | |
|---|---|---|---|---|
| 3,356,825 | A * | 12/1967 | Mills et al. | 219/212 |
| 3,588,446 | A * | 6/1971 | Mills | 219/501 |
| 4,198,562 | A * | 4/1980 | Mills et al. | 219/505 |
| 4,277,671 | A | 7/1981 | Mori et al. | 219/494 |
| 4,298,856 | A * | 11/1981 | Schuchardt | 338/195 |
| 4,315,141 | A * | 2/1982 | Mills et al. | 219/505 |
| 4,430,560 | A * | 2/1984 | Mills et al. | 219/505 |
| 4,549,074 | A | 10/1985 | Matsuo | 219/505 |
| 4,607,154 | A * | 8/1986 | Mills | 219/505 |
| 4,677,281 | A | 6/1987 | Mills | 219/505 |
| 4,849,611 | A * | 7/1989 | Whitney et al. | 219/538 |
| 5,582,757 | A | 12/1996 | Kio et al. | 219/548 |
| 6,172,343 | B1 * | 1/2001 | Nothe et al. | 219/501 |
| 6,331,695 | B1 | 12/2001 | West | 219/212 |
| 6,545,253 | B2 | 4/2003 | Lin et al. | 219/528 |
| 6,723,967 | B2 | 4/2004 | Rock et al. | 219/528 |

(Continued)

FOREIGN PATENT DOCUMENTS

| | | |
|---|---|---|
| GB | 2 115 245 | 9/1983 |
| GB | 2 123 994 | 2/1984 |
| WO | WO 8810056 A1 * | 12/1988 |
| WO | WO 97/10637 | 3/1997 |
| WO | WO 99/30535 | 6/1999 |

OTHER PUBLICATIONS

Patent Cooperation Treaty PCT International Search Report. Date of Mailing, Sep. 18, 2007. International Application No. PCT/US2007/009338.

*Primary Examiner* — Stephen J Ralis
(74) *Attorney, Agent, or Firm* — Cheryl J. Brickey

(57) ABSTRACT

The warming article contains a heating element and a sensing system. The sensing system has a first sensor element being a temperature dependent variable resistor and a second sensor element having at least two resistors in series and corresponding jumpers for one or more resistors in the second sensor element. The first sensor element is linear and flexible and the second sensor element is used to adjust the total sensor resistance to a fixed value at a particular temperature.

7 Claims, 4 Drawing Sheets

U.S. PATENT DOCUMENTS

| | | | | |
|---|---|---|---|---|
| 6,770,848 | B2 | 8/2004 | Haas et al. | 219/212 |
| 6,958,463 | B1 * | 10/2005 | Kochman et al. | 219/544 |
| 2002/0050265 | A1 | 5/2002 | Yoshida et al. | 123/295 |
| 2004/0026405 | A1 | 2/2004 | Alvite et al. | 219/486 |
| 2005/0007406 | A1 | 1/2005 | Haas et al. | 347/17 |
| 2005/0067404 | A1 | 3/2005 | DeAngelis et al. | 219/545 |
| 2006/0001727 | A1 | 1/2006 | Haas et al. | 347/194 |
| 2006/0060576 | A1 | 3/2006 | Haas et al. | 219/543 |

* cited by examiner

*FIG. –5–*

CALIBRATED THERMAL SENSING SYSTEM UTILIZING RESISTANCE VARYING JUMPER CONFIGURATION

FIELD OF THE INVENTION

The present invention refers to the temperature control of a warming article, more particularly, to a temperature control method for controlling a heater such as an electric blanket or an electric carpet in response to a detection signal from a temperature sensor arranged together with the heater in the electric blanket or carpet.

BACKGROUND

Warming articles, such as warming blankets and warming mattress pads typically include a user control, such as a dial, that permits a user to set the relative amount of heat output of the blanket. As an example, a user control for a warming article may include settings 1 to 10, with 10 being the warmest setting, and 1 being the least warm. These settings are a relative temperature scale and a setting of 7 on one warming article may not be the same temperature as a setting of 7 on another similar article. This relative temperature measurement requires only gross determination of the temperature of the warming article. Sometimes temperature determination is also used to set an upper safe limit. In both cases, precise calibration of temperature is not required.

Furthermore, an arbitrary numbering system does not provide an intuitive idea of how warm the article will get. A user may know they are comfortable at 72 degrees Fahrenheit. It is preferable, therefore, to have a warming article in which the heating may be set using a known temperature scale rather than an arbitrary numbering scale. However, this requires a control system that has precise knowledge of the temperature of the warming article.

There is thus a need for a warming article with sensor feedback that is precisely correlated to the actual temperature such that each standardized controller will work with any sensor and warming article.

BRIEF DESCRIPTION OF THE DRAWINGS

An embodiment of the present invention will now be described by way of example, with reference to the accompanying drawings.

DETAILED DESCRIPTION

Figure 1:
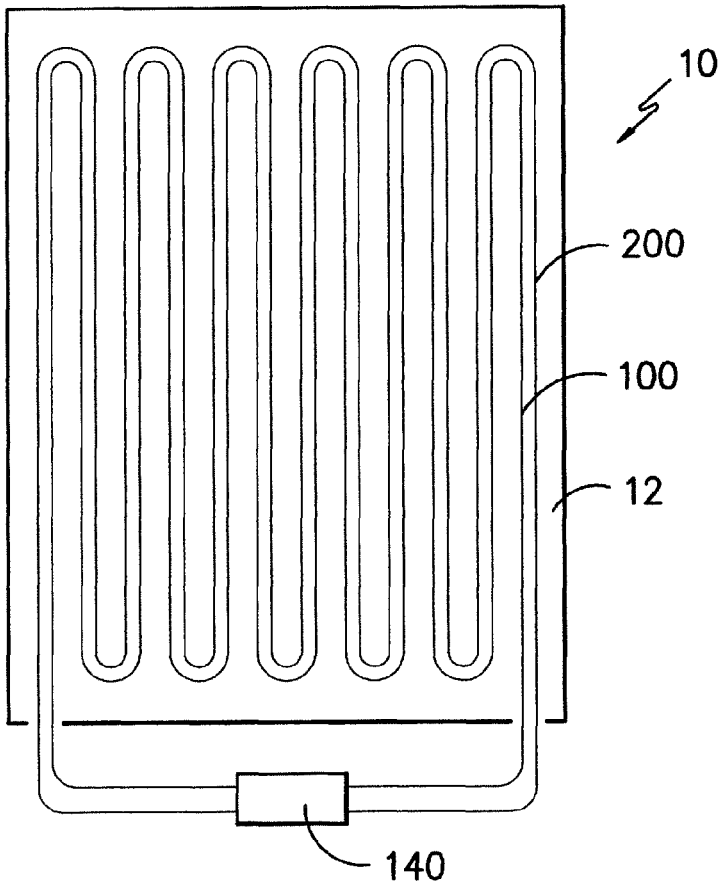
FIG. 1 is a view of one embodiment of the warming article.

FIG. 1 shows the warming article 10 as a warming blanket comprising a heating element 200 and a sensing system 100. The heating element 200 delivers the heat through the blanket to the user, the sensing system 100 is used to sense the temperature of the blanket, and the controller 140 controls the amount of heat given off by the warming article 10.

The warming article 10 of the invention has a sensing system 100 that uses precise calibration of the sensor system such that the sensor feedback can be precisely correlated to the actual temperature. Additionally, each sensing system is calibrated so that it will work with any controller—each controller does not have to be matched to a particular sensor. Calibration and standardization means that for a set drawn from a given type of controller and sensor system, any controller will work with any sensor system and warming article. This is advantageous, for example, when a family has multiple warming blankets and removes the controllers from the blankets for laundering; the controllers are interchangeable so that the blankets could be used with any of the controllers. It has an additional advantage in production in that it is not necessary to pair and then track a particular controller and sensor system.

Similarly configured controllers may be used with any similarly configured sensor, even when there is significant variation from sensor to sensor. This variation often happens in textile-based heating systems incorporating strands of a temperature-dependent variable resistor (TDVR) as the sensor. The controller must know the baseline resistance of the sensor, the resistance at a fixed temperature. In textile-based systems it can be difficult from a practical standpoint to sufficiently control the resistance of the sensor from system to system, so that different sensors have significantly different baseline resistances.

Figure 2:
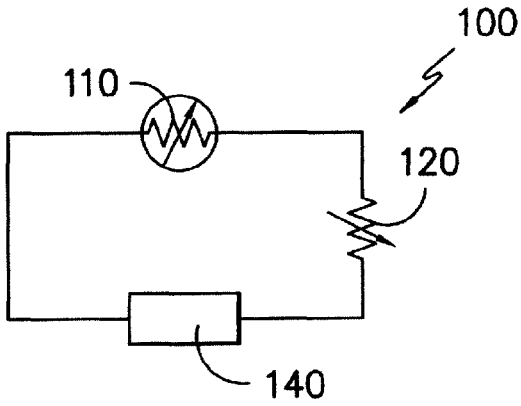
FIG. 2 is a view of one embodiment of the warming article sensing system with first and second sensor elements in series.
Figure 3:
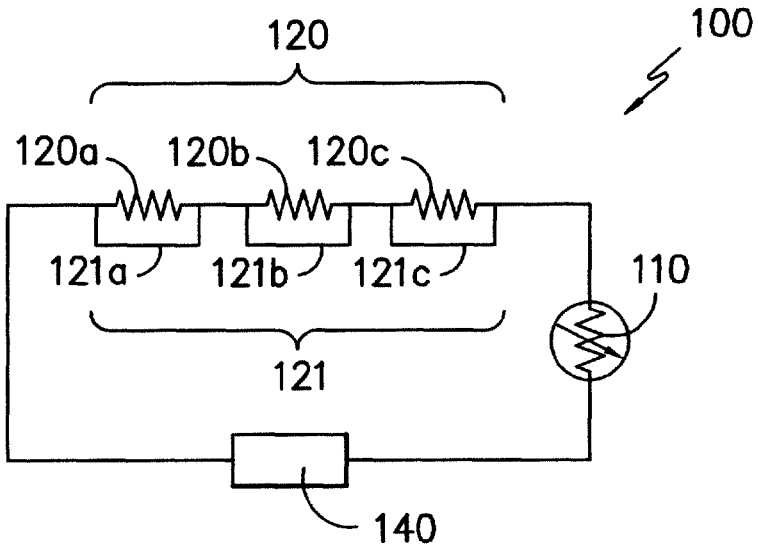
FIG. 3 is a view of one embodiment of the warming article sensing system.
Figure 4:
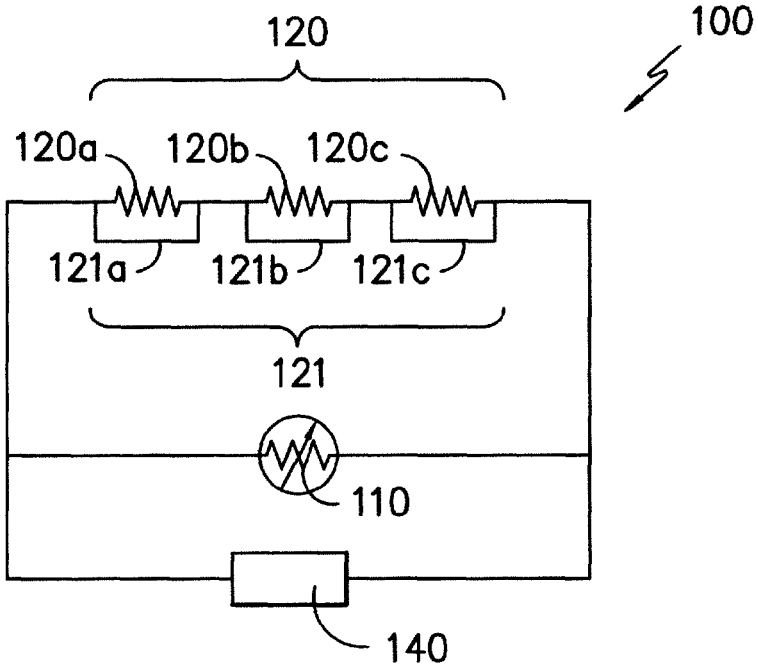
FIG. 4 is a view of one embodiment of the warming article sensing system.

Some arrangements for the sensing system 100 may be found in FIGS. 2-4. The sensing system, in some embodiments, comprises a first sensor element 110 which is a temperature dependent variable resistor (TDVR) and a second sensor element 120 being a variable resistor (VR). The first sensor element 110 is linear, elongated, and flexible. It runs throughout the warming article 10 so that the average temperature of the first sensor element 110 is related to the average temperature over the warming element 10. In one embodiment, the first sensor element 110 is a conductive wire. This arrangement serves to adjust the baseline resistance of the sensing system 100 to a set value that is assumed by the controller 140 by setting the resistance of the second sensor element 120. FIGS. 2-4 are schematics in which the TDVR first sensor element 110 is depicted as a resistor and the TIVR second sensor element or elements 120 are depicted as a resistor or resistors.

The first sensor element 110 is a temperature dependent variable resistor (TDVR), designed so that its resistance is directly proportional to its average temperature. The relationship between temperature and resistance is the temperature coefficient. To improve the signal-to-noise ratio when determining temperature, the TDVR may be designed to have as large a temperature coefficient as practical.

Ideally, the second sensor element 120 would have the same temperature coefficient as the first sensor element 110, that is, it would also be a TDVR. In practice, the second sensor element 120 is often part of a printed circuit board or other conventional electronic device or controller and it is not practical to make it out of the same materials as the first sensor element. As such, it is useful if the second sensor element 120 is a commercially available resistor. Such resistors typically have a much smaller temperature coefficient than does the first sensor element 110.

Often the second sensor element 120 is located outside the area over which the temperature is to be measured, in an environment where the temperature changes less than in the environment of the first sensor element 110. This further reduces the resistance change of the second sensor element 120 relative to that of the first sensor element 110. In practice, the temperature-related resistance change of the second sensor element 120 typically is much smaller that that of the first sensor element 110, and so the second sensor element 120 will be referred to as a temperature independent variable resistor (TIVR) for this specification. However, the second sensor element is not limited to being a TIVR and may be any type of variable resistor whose resistance can be externally set. This includes combinations of resistors that, for purposes of analyzing the complete circuit, can be treated as one resistor.

To the extent that the changes in resistance of the TDVR and TIVR are different, use of the TIVR will introduce an error in the temperature measurement of the sensing system 100.

The resistance of the TIVR may change for reasons other than temperature (such as manual adjustment), and so it is still referred to it as a variable resistor. In fact, as is described below, it is often preferable that the manufacturer be able to adjust the resistance of the second sensor element 120. So, for example, the TIVR may be a potentiometer, or it may be a combination of resistors that can be selectively included in the TIVR sensor element(s).

In order for the TDVR first sensor element 110 to respond to the temperature over large areas of the sensor system 100, the TDVR first sensor element 110 is linear and flexible. In this case, linear refers to its spatial extent, being much longer in one of its dimensions than in either of the other two dimensions. The first sensor element 110 should also be flexible, so that it can be incorporated throughout the warming article 10, for example in a serpentine pattern as shown in FIG. 1. In addition, it should not restrict the flexibility of the warming article.

The TIVR (the second sensor element in FIGS. 2-4) need not be linear or flexible; as discussed above, it usually is not.

The warming article 10 measures the resistance R of the sensing system 100 including the TDVR sensor element 110 to determine the average temperature T of the sensor element 110. Ignoring for a moment the presence of the TIVR second sensor element 120, the controller can determine the average temperature from the measured resistance by using a calculation or look-up table based on $$T-T_o=[(R/R_o-1)]/\alpha_o \quad \text{(Equation 1)}$$

where $R_o$ is the baseline resistance of the sensor system and $\alpha_o$ is the temperature coefficient of the sensor material at temperature $T_o$. The TIVR second sensor element 120 introduces an error in this equation which is discussed below. This error can be determined and controlled so that the average temperature of the warming article can be determined. Furthermore, as will now be shown, the second sensor element allows adjustment for differences in the baseline resistance from one sensor system to another. This allows use of a single calculation or look-up table for all sensor systems and greatly increases the accuracy of the temperature determination.

In one embodiment as shown in FIG. 2, a desired baseline resistance $R_o$ for the sensing system 100 is chosen that is greater than, but close to, the resistance R of the first sensor element 110. The resistance of the first sensor element 110 is measured at the baseline temperature $T_o$ and a correction resistance ΔR is added in series in the second sensor element 120 so that the total resistance R+ΔR equals the desired baseline resistance $R_o$. If the resistance of the second sensor element 120 has the same TDVR behavior as the first sensor element 110, then there will be little or no error in the inferred temperature. If, as is usually practical, the added resistance has very little change with temperature, then there will be an error ΔT in the inferred temperature exactly equal to $$\Delta T=\Delta R/R_o*(T-T_o) \quad \text{(Equation 2)}$$

As before, $R_0$ and $T_0$ are the baseline resistance and temperature. The error ΔT is minimized when ΔR is minimized, so it is still desirable to minimize the distribution of resistances of the TDVR first sensor element 110. It is also desirable to choose the smallest necessary correction ΔR, keeping in mind that it must raise the resistance of the least resistive first sensor element 110 to the desired baseline resistance $R_0$. In practice, the error ΔT can be kept small.

The configuration in FIG. 2 allow adjustment of the sensor system 100 so that it has a baseline resistance $R_o$ in the cases where the first sensor element 110 has a resistance R that is less than the baseline resistance. Other configurations allow adjustment in the case where the first sensor element 110 has a resistance R that is greater than the baseline resistance, or in the case where the first sensor element 110 has a resistance R that may be greater or less than the baseline resistance Another method of adjusting the series or parallel resistance is to build second sensor element 120 from multiple resistors that can be selectively included, for example by cutting a jumper that provides a short circuit across the resistor. An example is shown in FIG. 3. Second sensor element 120, in series with first sensor element 110, is made of three resistors, 120*a*, 120*b*, and 120*c*. Across each resistor is a corresponding jumper 121*a*, 121*b*, and 121*c*. Each resistor can be added to the circuit by cutting its corresponding jumper, or it can be left out of the circuit by leaving its corresponding jumper intact.

A similar method can be used to make an adjustable parallel resistance as shown in FIG. 4. This idea can be applied to combinations of resistors in any configuration, e.g., resistors in parallel with the first sensor element 110, some resistors in series and others in parallel with the first sensor element 110, or second sensor element resistors in series and/or parallel with each other. This includes combinations of resistors that, for purposes of analyzing the complete circuit, can be treated as one resistor.

Preferably the sensing system controls the warming article temperature to within two degrees Fahrenheit of the set point, more preferably to within one degree Fahrenheit.

Figure 6:
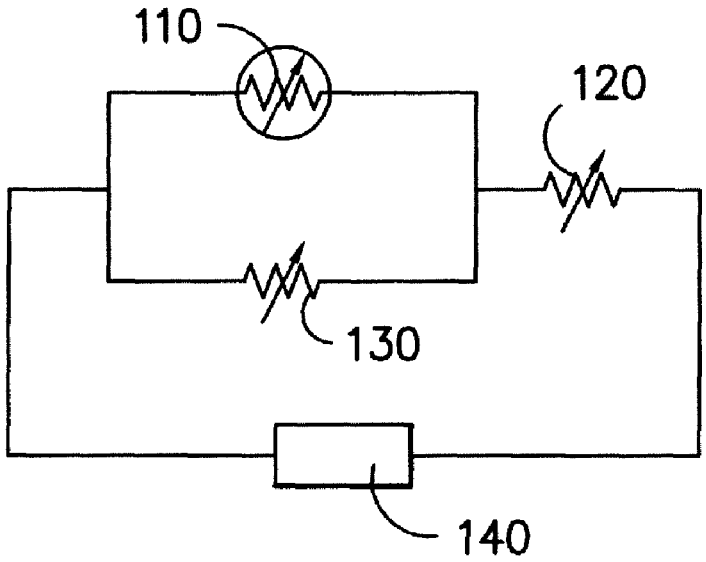
FIGS. 6-7 illustrate embodiments of the warming article sensing system having first, second, and third sensor elements.
Figure 7:
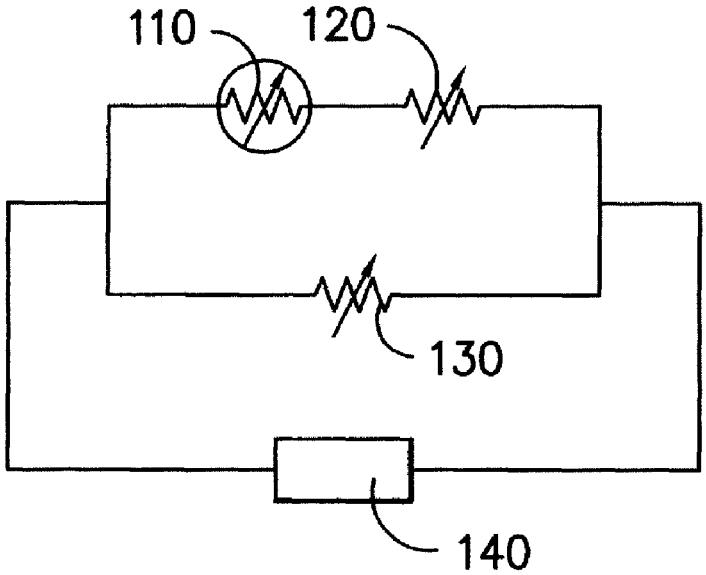

In one embodiment warming article 10 further includes a third sensor element 130 being a variable resistor, where the first sensor element 110 is electrically connected in parallel to the third sensor element 130 and where the second sensor element 120 is electrically connected in series to the combination of the first sensor element 110 and the third sensor element 130. This is shown in FIG. 6. In another embodiment, the warming article 10 further includes a third sensor element 130 being a variable resistor, where the first sensor element 110 is electrically connected in series to the second sensor element 120 and where the third sensor element 130 is electrically connected in parallel to the combination of the first sensor element 110 and the second sensor element 120. This is shown in FIG. 7.

Any conductive material can be used for the TDVR sensor element, so long as the conductivity changes over the temperature range to be monitored, and the material can be made into flexible strands. Conductivity of the TDVR can either increase or decrease with temperature. The larger the temperature coefficient $\alpha_r$ of the material, the greater the signal of a change in temperature. It is preferable that the temperature behavior of the material be stable over time. It is also preferable that the resistance have a linear dependence on the temperature over the range of interest.

Preferred materials for the TDVR sensor strands include most metals, including copper, silver, and stainless steel. Among common metals, nickel has a particularly high temperature coefficient. Copper is highly ductile and readily available as strands. Metals may be incorporated as wires or strands, or they may be incorporated as strands wrapped around a flexible nonconductive core, such as a plastic filament yarn. They may also be coatings on flexible nonconductive strands.

Preferred materials also include conductive polymers, including intrinsically conducting polymers (ICPs) such as polypyrrole, polyaniline, and polythiophene and yarns or strands coated with ICPs, as well as nonconductive polymers loaded with conductive particles such as carbon particles, metal particles, metal coated glass beads, metal oxide particles, and metal oxide coated glass beads. Such materials often have larger coefficients than metals, such as described in U.S. Pat. No. 6,497,591.

Other preferred materials include semiconductors, such as silicon or germanium, which often have large temperature coefficients. While these materials may not be flexible, when formed into thin strands or used as coatings on flexible non-conductive strands they can be included as a flexible sensor.

The warming article 10 may be heated garments, such as jackets, sweaters, hats, gloves, shirts, pants, socks, boots, and shoes, and/or home furnishing textile articles, such as blankets, throws, warming pads, warming mats, seat warmers, mattress pads, mattresses, seating, and upholstery. The warming article 10 may contain fabric that is of any stitch construction suitable to the end use, including by not limited to a woven, knitted, non-woven material, tufted materials, or the like. Woven textiles can include satin, twill, basket-weave, poplin, and crepe weave textiles. Jacquard woven structures are also preferred as they are able to create a more complex electrical pattern.

In addition to apparel and home furnishings, the warming article may be configured to provide heat to any number of consumer products such as baby bottles, baby carriages, pet accessories, pool coverings, vehicle seats, or floor coverings such as carpets, tile, or wood. The warming article may also be configured to provide heat to military troop gear such as sleeping bags, hospital and patient products, or farming products such as for livestock. The warming article may also be utilized to melt snow on, for example, a sidewalk or driveway. Additional examples, too numerous to mention, are also contemplated.

The warming article 10 is electrically connected to a power source to supply electrical power for heat generation. Electricity may be applied in many methods, including but not limited to a cigarette lighter or other power outlet of an automobile, alternating current from a household outlet, or direct current from, for example a battery pack. Additional alternative power sources include photovoltaic panels and fuel-cells.

The warming article 10 may incorporate several safety devices and indications to protect the user from potential injury. For example, if the temperature of the warming article climbs above a certain temperature, the controller 140 may automatically shut off the power to the warming article. Alternatively, the controller may prevent the user from setting the temperature too high.

EXAMPLE

Figure 5:
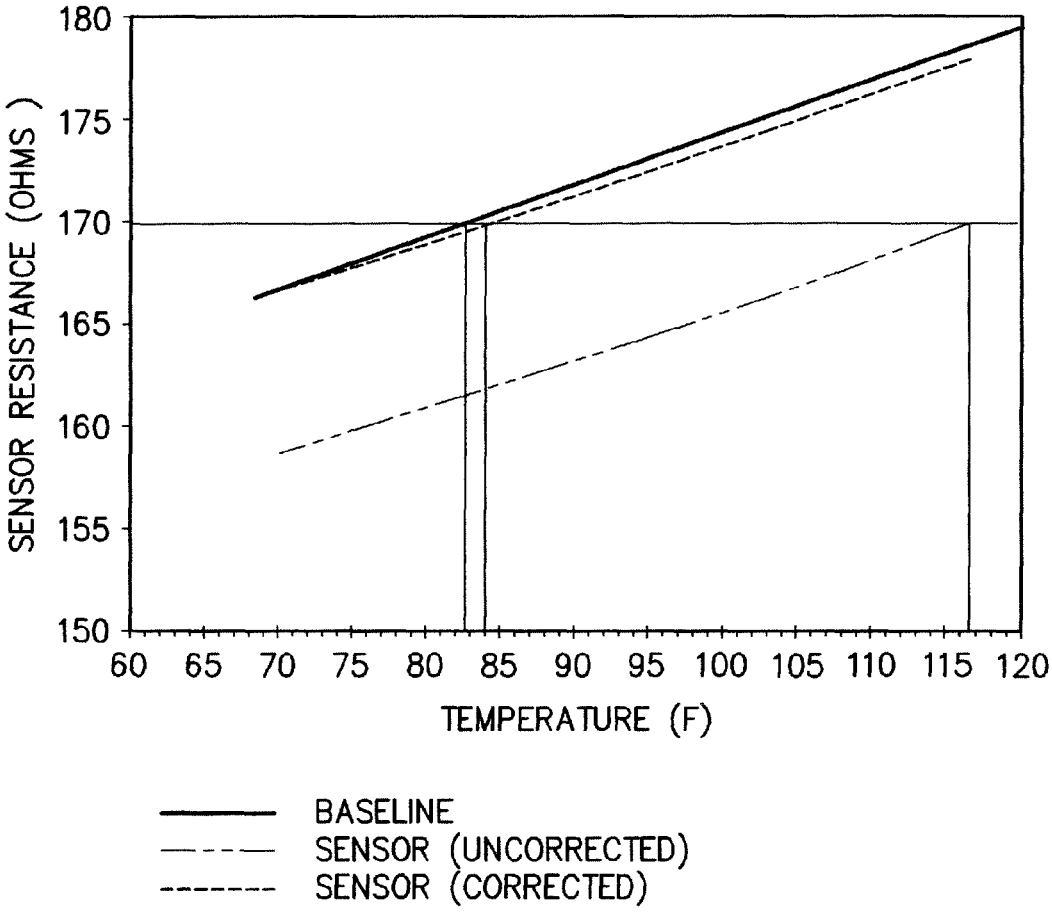
FIG. 5 is a graph of resistance versus temperature for corrected and uncorrected sensor systems.

A linear, flexible, 104 foot long TDVR baseline sensor was made by wrapping a 36 AWG wire made of Percon 19 metal (available from Fisk Alloy Conductors, Incorporated of Hawthorne, N.J.) around a 1000 denier polyester filament yarn at 50 turns per inch and coating with PVC insulation. The resistance of the sensor is shown in FIG. 5 labeled as "Baseline." A second sensor was made, identical to the baseline sensor in all respects except that the second sensor was only 99 feet long. The resistance of the second sensor is shown in FIG. 5 labeled as "Sensor (uncorrected)." Finally, a calibration resistor was added in series to the second sensor. The resistance of the sensor-resistor pair is shown in FIG. 5 labeled as "Sensor (corrected)." Even though the added resistor is, practically speaking, a temperature independent resistor, it adjusts the resistance of the second sensor system so that it matches the baseline resistance over a wide temperature range.

For example, the baseline system has a resistance of 170 ohms at a temperature of 82.5 F. That same resistance occurs in the uncorrected sensor at a temperature of 116.5 F—an error of 34 degrees. In the corrected system, a resistance of 170 ohms occurs at 84 F, an error of only 1.5 degrees. The calibrating resistor reduces the error 96%.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

The invention claimed is:

1. A warming article comprising a fabric, a heating element incorporated into the fabric and, a sensing system, wherein the sensing system comprises a first sensor element being a temperature dependent variable resistor, wherein the temperature dependent variable resistor is linear and flexible and is incorporated into the fabric; and, a second sensor element being a temperature independent variable resistor comprising a combination of at least two resistors in series and corresponding jumpers for each of the resistors in the second sensor element.

2. The warming article of claim 1, wherein the first sensor element is electrically connected in series to the second sensor element.

3. The warming article of claim 1, wherein the first sensor element is electrically connected in parallel to the second sensor element.

4. The warming article of claim 1, further comprising a third sensor element being a variable resistor, wherein the first sensor element is electrically connected in parallel to the third sensor element and wherein the second sensor element is electrically connected in series to the combination of the first sensor element and the third sensor element.

5. The warming article of claim 1, further comprising a third sensor element being a variable resistor, wherein the first sensor element is electrically connected in series to the second sensor element and wherein the third sensor element is electrically connected in parallel to the combination of the first sensor element and the second sensor element.

6. The warming article of claim 1, wherein the first sensing element is an electrically conductive wire.

7. The warming article of claim 1, wherein the second sensor element comprises at least three resistors in series and corresponding jumpers for each resistor.

* * * * *